US006626516B2

(12) United States Patent
Tsukuda

(10) Patent No.: US 6,626,516 B2
(45) Date of Patent: Sep. 30, 2003

(54) INK JET PRINTING APPARATUS, METHOD OF SUPPLYING INK AND METHOD OF RECOVERING INK JET PRINT HEAD

(75) Inventor: Keiichiro Tsukuda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/954,071

(22) Filed: Sep. 18, 2001

(65) Prior Publication Data

US 2002/0041305 A1 Apr. 11, 2002

(30) Foreign Application Priority Data

Sep. 20, 2000 (JP) ..... 2000-285367

(51) Int. Cl.[7] ..... B41J 2/165

(52) U.S. Cl. ..... 347/35; 347/29; 347/30; 347/85

(58) Field of Search ..... 347/35, 29, 32, 347/33, 85, 86, 87, 89, 92, 30

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,326 A | | 12/1985 | Kimura et al. | 347/30 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 4,897,665 A | * | 1/1990 | Aoki | 347/10 |
| 5,801,735 A | | 9/1998 | Lorenze, Jr. et al. | 347/85 |
| 6,050,682 A | | 4/2000 | Pawlowski, Jr. et al. | 347/92 |
| 6,267,474 B1 | * | 7/2001 | Mochizuki | 347/86 |

FOREIGN PATENT DOCUMENTS

| | | |
|---|---|---|
| EP | 0 370 765 | 5/1990 |
| EP | 1 033 252 | 9/2000 |
| JP | 54-56847 | 5/1979 |
| JP | 59-123670 | 7/1984 |
| JP | 59-138461 | 8/1984 |
| JP | 60-71260 | 4/1985 |

OTHER PUBLICATIONS

European Search Report dated Dec. 20, 2001.
U.S. application No. 09/986,003, filed Nov. 7, 2001 pending.

* cited by examiner

*Primary Examiner*—Shih-wen Hsieh
(74) *Attorney, Agent, or Firm*—Fitzpatrick, Cella, Harper & Scinto

(57) ABSTRACT

The ink jet printing apparatus has an ink moving device for returning almost all of the ink in the sub ink tank to the main ink tank. The method of supplying ink has a first step of returning the ink in the sub ink tank to the main ink tank, a second step of discharging bubbles in the sub ink tank out of the sub ink tank, and a third step of, after the first step, supplying a predetermined amount of ink from the main ink tank to the sub ink tank. The method of recovering the ink jet print head has a first step of returning the ink in the sub ink tank to the main ink tank, and a second step of discharging the ink from the print head by, after the first step, applying an external pressure against any part of the ink supply path.

12 Claims, 6 Drawing Sheets

INK JET PRINTING APPARATUS, METHOD OF SUPPLYING INK AND METHOD OF RECOVERING INK JET PRINT HEAD

This application is based on Patent Application No. 2000-285367 filed Sep. 20, 2000 in Japan, the content of which is incorporated herein by reference.

BACKGROUND OF THE INVENTION

1. Field of the Invention

The present invention relates to an ink jet printing apparatus that ejects ink for printing, to a method of supplying ink and to a method of recovering an ink jet print head. More particularly, the present invention relates to an ink jet printing apparatus having an ink supply device for supplying ink to the ink ejecting print head, to a method of supplying ink for the ink jet printing apparatus and to a method of recovering the print head thereof.

2. Description of the Related Art

Heretofore, an ink jet printing apparatus that prints on a print medium by ejecting ink has the advantages of being very silent during operation, small in size and inexpensive and thus have found recently a wide range of applications. An ink jet print head used in such an ink jet printing apparatus to eject ink onto a print medium for printing are classed into two types: one that uses a piezoelectric element and the other, called a bubble jet type, which uses an electrothermal transducer to cause a film boiling in ink and eject ink by a force of a generated bubble.

A known method for supplying ink to the print head involves installing on a carriage a sub tank capable of accommodating a small amount of ink and supplying ink to the sub tank from a main ink tank. This method can increase the carriage speed and is thus suited for high-speed printing. In addition, because the main tank can have a large capacity, this method is advantageously applied for a large volume printing. There are many constructions proposed for such an ink supply method. Among them is a pit-in type in which during a non-printing period the sub tank is automatically refilled by a large-capacity main ink tank set at an arbitrary location in the ink jet printing apparatus. Another example construction for such a method has the main ink tank installed at other than the carriage of the ink jet printing apparatus and supplies ink from the main ink tank to the sub tank through a tube. In these printing apparatus, the sub tank has a function of temporarily holding bubbles when air entering the ink emerges as bubbles and thereby minimizing adverse effects on printing.

As the percentage of the bubbles in the sub tank increases, there is a possibility that, due to environmental changes such as temperature variations at a location of the printing apparatus, the bubble may expand and cause the ink to leak out of the print head.

To deal with this problem a variety of methods have been proposed to reduce or eliminate the bubbles remaining in the sub ink tank. For example, one method deaerates the ink contained in the main ink tank. This method requires a step of deaeration and must hermetically enclose the ink tank during transport or in use. Another method of eliminating bubbles in the sub ink tank comparatively reduces the volume of the sub ink tank and eliminates the ink and the bubble from the sub ink tank at the same time by suction. This method, however, increases the amount of discarded ink. Further, if the amount of bubbles, i.e., the amount of ink, in the sub ink tank is not known, the number of recovery operations and therefore the amount of discarded ink tend to increase making it necessary to check the amount of remaining ink in the sub ink tank.

OBJECT OF THE INVENTION

The present invention has been accomplished to solve the above-described problems and it is therefore an object of the present invention to provide an ink jet printing apparatus with a main tank and a sub tank, a method of supplying ink and a method of recovering an ink jet print head, which offer a simple construction and can reliably eliminate bubbles while minimizing the amount of discarded ink even when the amount of bubbles in the sub tank is not clearly known.

SUMMARY OF THE INVENTION

To achieve the above objective, the ink jet printing apparatus of the present invention comprises; an ink jet print head for ejecting ink, a sub ink tank for temporarily holding the ink to be ejected from the print head, a main ink tank for holding the ink to be supplied to the sub ink tank, and an ink moving means for returning almost all of the ink in the sub ink tank to the main ink tank.

The method of supplying ink of the present invention is used for the ink jet printing apparatus, wherein the ink jet printing apparatus comprises an ink jet print head for ejecting ink, a sub ink tank for temporarily holding the ink to be ejected from the print head, and a main ink tank for holding the ink to be supplied to the sub ink tank, the method of supplying ink comprises; a first step of returning the ink in the sub ink tank to the main ink tank, a second step of discharging bubbles in the sub ink tank out of the sub ink tank, and a third step of, after the first step, supplying a predetermined amount of ink from the main ink tank to the sub ink tank.

The method of recovering the ink jet print head of the present invention is used for the ink jet printing apparatus with an ink supply path, and the method of recovering the ink jet print head comprises, a first step of returning the ink in the sub ink tank to the main ink tank, and a second step of discharging the ink from the print head by, after the first step, applying an external pressure against any part of the ink supply path.

With the ink jet printing apparatus, the method of supply ink and the method of recovering the ink jet print head according to the present invention, because the ink in the sub ink tank is returned to the main ink tank and because the amount of ink to be supplied from the main ink tank to the sub ink tank is known, the ink can be prevented from overflowing from the sub ink tank when the recovery operation is performed. A predetermined amount of ink can be injected into the sub ink tank during the recovery operation.

Further, in the ink jet printing apparatus of the present invention, the ink jet print chip having energy generating elements for ejecting ink and a nozzle portion for ejecting ink may be arranged on one of surfaces of the sub ink tank. This construction offers an advantage, in addition to those described above, of being able to appropriately restore the nozzle portion from clogging.

Further, in the ink jet printing apparatus of the present invention, the main ink tank and the sub ink tank for storing ink may be connected together through a tube. This construction offers an advantage, in addition to those described above, of being able to restore the nozzle portion from clogging with a small amount of discarded ink.

Further, in the ink jet printing apparatus of the present invention, the main ink tank for storing ink may be arranged at a height lower than the ink jet print head. In that case, there is an advantage, in addition to those described above, that the positional difference between the main ink tank and the ink jet print head can be utilized as an attitude difference appropriately in returning the ink to the main ink tank during the recovery operation.

Further, in the ink jet printing apparatus of the present invention, the sub ink tank may have a valve to communicate the interior of the sub ink tank to the external air. By using the positional difference between the sub ink tank and the main ink tank, the external air can easily be taken into the sub ink tank, contributing to the proper discharging of the ink out of the sub ink tank.

Further, in the ink jet printing apparatus of the present invention, the means for discharging the ink out of the sub ink tank may be one that deforms the sub ink tank. In that case, because the ink can be discharged properly as the sub ink tank is deformed, the clogging of the nozzle portion can be eliminated with a small amount of discarded ink.

Further, in the ink jet printing apparatus of the present invention, because the supply of ink to the sub ink tank is done by the pit-in system that connects the sub ink tank to the main ink tank when necessary, it is possible to easily and properly replace the sub ink tank.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Embodiment 1

Figure 2:
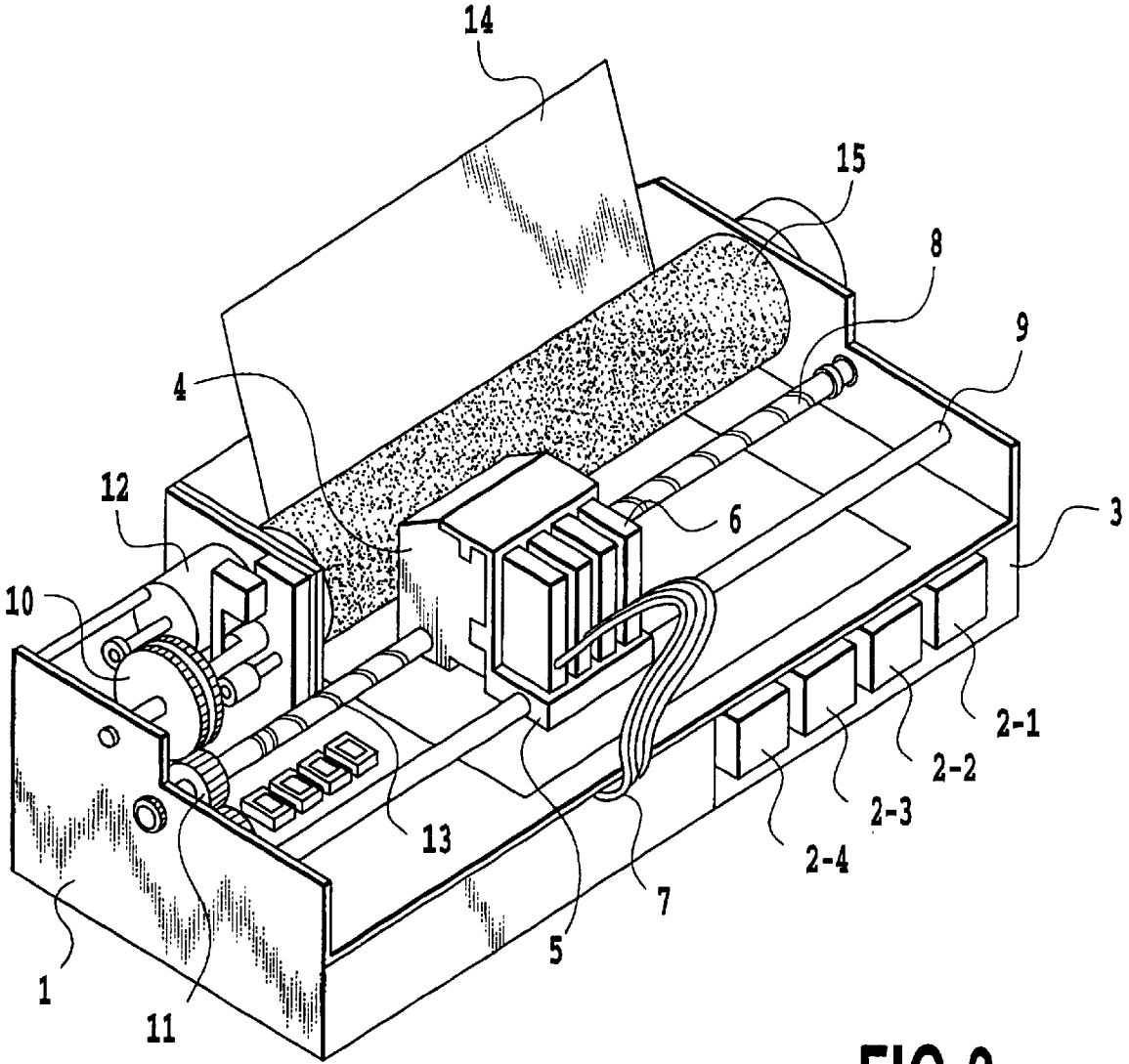
FIG. 2 is a schematic diagram showing the ink jet printing apparatus as the first embodiment of the present invention.

FIG. 2 schematically shows a first embodiment of the ink jet printing apparatus according to the present invention. As shown in the figure, this printing apparatus supplies ink to the ink jet print head from an ink tank through a tube.

As shown in the figure, the ink jet printing apparatus of the present invention mainly comprises: a housing 1 such as a main frame; a main ink tank 2 having ink tanks 2-1, 2-2, 2-3, 2-4 inserted into a recessed portion 3 formed in a side portion of the housing 1; an ink jet print head 4 having an ink jet print chip with nozzles for ejecting ink; a carriage 5 removably mounting the print head 4 and scanning it for printing; sub ink tanks 6 for temporarily storing ink; ink supply tubes 7 as ink supply paths for connecting the ink tanks 2-1, 2-2, 2-3, 2-4 of the main ink tank 2 to the corresponding sub ink tanks 6; a lead screw 8 formed with a spiral groove 13 to reciprocate the print head 4 and the carriage 5 together as one piece in a main scan direction over a print medium 14 such as print paper and plastic thin plate; a guide rail 9 for reciprocally guiding the carriage 5; a drive motor 12 for rotating the lead screw 8 through gears 10, 11; and a platen roller 15 for feeding the print medium 14 to a print position.

In the ink jet printing apparatus of the present invention, when joint portions (not shown) of the ink tanks 2-1 to 2-4 of the main ink tank 2 to be inserted into the recessed portion 3 of the housing 1 are not inserted into the ink jet printing apparatus, they are closed by rubber plugs 2*a* for preventing ink leakage. When the ink tanks 2-1 to 2-4 of the main ink tank 2 are inserted into the recessed portion 3 of the ink jet printing apparatus, the rubber plugs 2*a* are pierced by ink supply needles 21*a* provided to the printing apparatus in order to draw out ink from the individual ink tanks 2-1 to 2-4. There are ink tank sensors in the ink jet printing apparatus to detect when the ink tanks 2-1 to 2-4 of the main ink tank 2 are mounted or dismounted. When the ink tanks 2-1 to 2-4 are removed from the printing apparatus, the ink supply tubes 7, 21 are closed to prevent the ink in the ink supply tubes 7, 21 from spilling out.

The ink jet print head 4 is removably mounted on the carriage 5 that performs a scanning operation for printing. The carriage 5 is provided with a printing apparatus side connector pad (not shown) that connects to a print head side connector pad (not shown). The sub ink tanks 6 for temporarily storing inks communicate with the ink tanks 2-1, 2-2, 2-3, 2-4 of the main ink tank 2 through the individual ink supply tubes 7, which function as ink supply paths. The lead screw 8 is rotated by the forward or backward rotation of the drive motor 12 through the gears 10, 11 to cause the print head 4 together with the carriage 5 to scan over the print medium 14 such as print paper and plastic thin plate. At this time, the carriage 5 is guided along the guide rail 9. Because the spiral groove 13 of the lead screw 8 engages an engagement portion (not shown) of the carriage 5, the scan motion of the carriage 5 is performed by the drive motor 12 in the longitudinal direction of the printing apparatus. The print medium 14 thus printed is fed and discharged by the platen roller 15.

Figure 1:
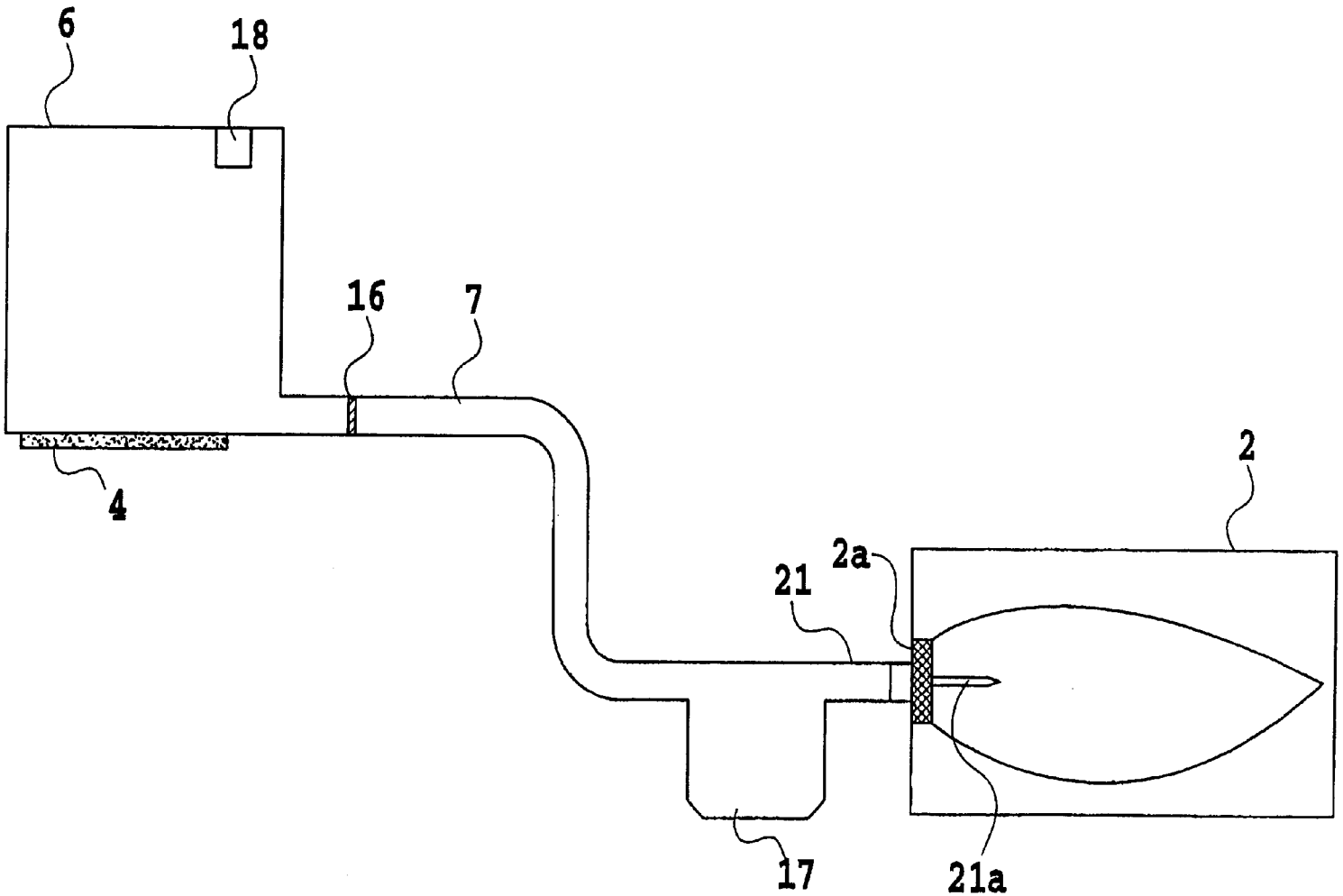
FIG. 1 is a schematic diagram showing an ink path from an ink tank to an ink jet print head mounted on the ink jet printing apparatus of a first embodiment of the present invention.

FIG. 1 schematically illustrates one of the ink paths from the print head 4 to the ink tanks 2-1, 2-2, 2-3, 2-4 of the main ink tank 2. The ink is supplied from the main ink tank 2, in which an ink-filled bag is accommodated, through the ink supply tube 7 and a dirt filter 16 in the sub ink tank 6 into the sub ink tank 6 having the print head 4.

The print head 4 comprises electrothermal transducers such as heaters which function as an energy generation means to eject ink, and a print head chip having a nozzle portion made from such a nozzle material as a resin orifice plate. The heater is applied energy to cause film boiling in ink to eject the ink from the nozzle.

In the ink supply tube 7, or the ink supply path, of the printing apparatus of this embodiment, an ink chamber 17 is provided which temporarily stores an amount of ink that is injected into the sub ink tank 6 during the recovery operation. The sub ink tank 6 has a valve 18 that is normally closed but, during the recovery operation, is opened to communicate the interior of the sub ink tank 6 to the external air.

Next, operations for supplying ink and for recovering the ejection performance will be explained in the case of this embodiment of the printing apparatus of the present invention constructed as described above.

Figure 3A:
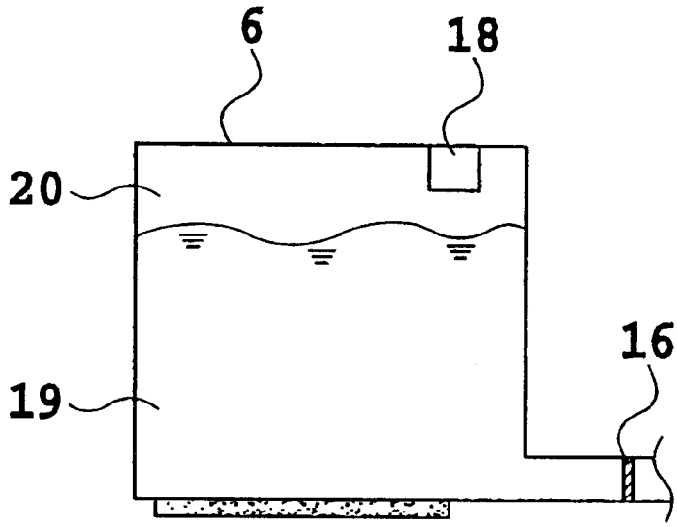
FIG. 3A and FIG. 3B are schematic diagrams showing states of a sub ink tank installed in the ink jet print head in the first embodiment of the present invention, with FIG. 3A representing an initial state and FIG. 3B representing a state after printing.
Figure 3B:
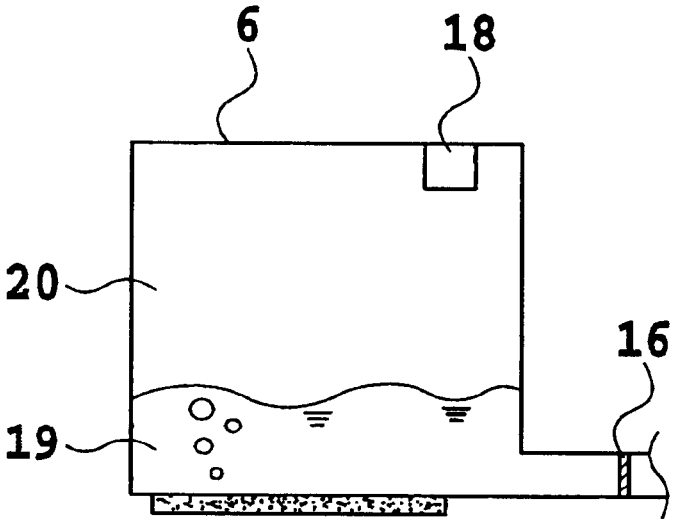

Initially, a sufficient amount of ink 19 exists in the sub ink tank 6 as shown in FIG. 3A with only a small amount of air 20 contained. As the printing operation proceeds, air mixes in the ink lowering the ink level as shown in FIG. 3B. If the printing is continued in this condition, the amount of ink 19 in the sub ink tank 6 becomes very small, making it difficult to supply ink to the chip of the print head 4 and to meet the desired print quality. It is therefore necessary to expel the air 20 from the sub ink tank 6 before the condition becomes intolerable. Simply drawing air out of the sub ink tank 6 by suction may cause a trouble. That is, since the ink level in the sub ink tank 6 is not known, when the ink level is high, there is a possibility, unless an ink level sensor is provided, that the air drawing operation may be done excessively, drawing out not only the air 20 but also the ink 19.

Figure 4:
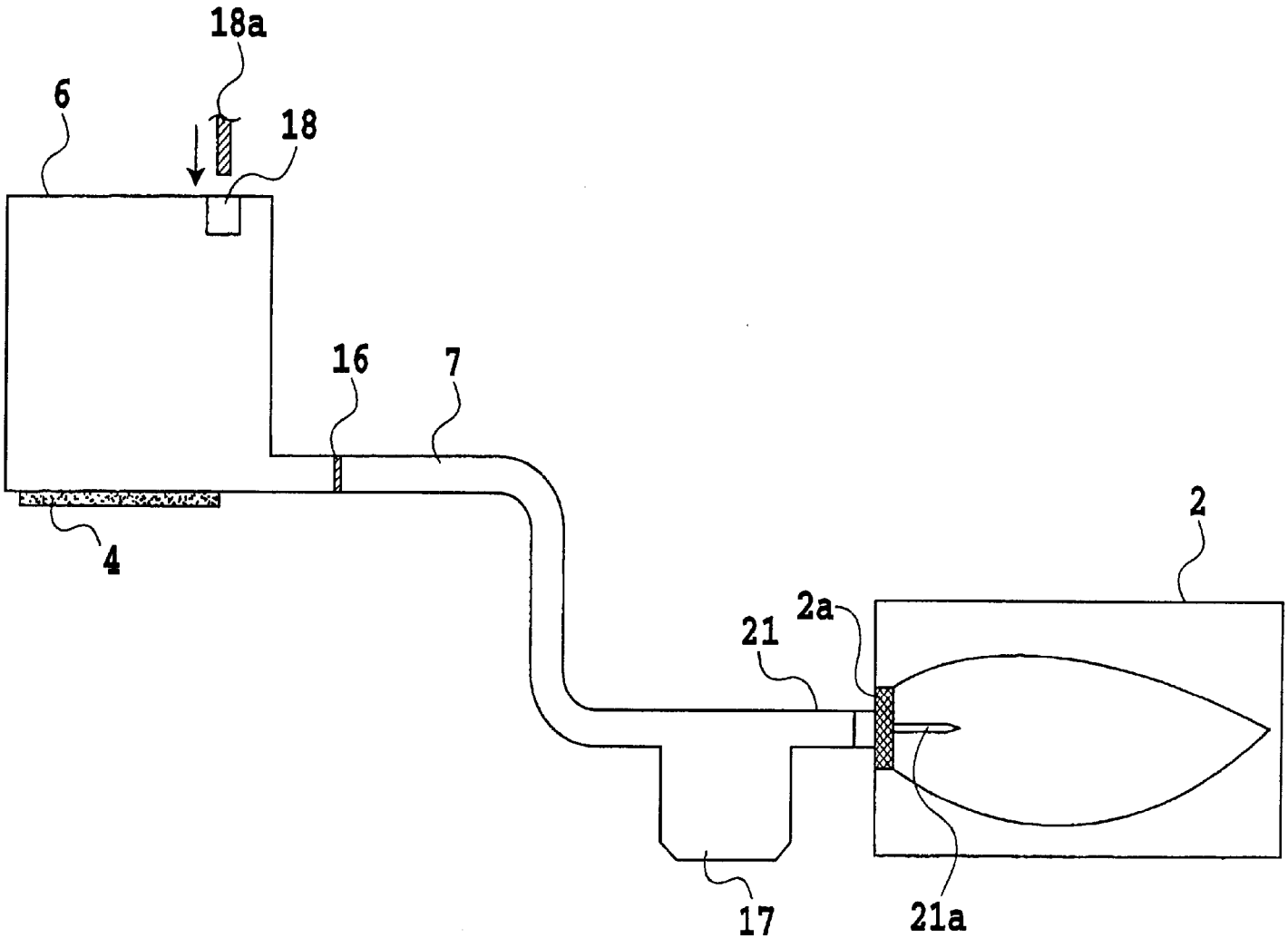
FIG. 4 is a schematic diagram showing a print head performance recovery procedure in the first embodiment of the present invention in a state before the start of this procedure.

To avoid this problem, the sub ink tank 6 needs to be restored to an original state by the procedure shown in FIG. 4 in this embodiment. For this purpose, the print head 4 is first moved to a recovery position in the printing apparatus. Then, as shown in FIG. 4, the valve 18 in the sub ink tank 6 is opened by using a motor in the printing apparatus or a pressing member 18*a* such as a protruding material. This allows the external air to enter into the sub ink tank 6 to raise the pressure in the sub ink tank 6 to the atmospheric pressure, with the result that the ink in the sub ink tank 6 returns to the main ink tank 2. When the sub ink tank 6 is emptied of the ink, the ink stops at the filter 16. This is explained as follows. Since a meniscus force produced at the nozzle portion of the print head 4 and the filter 16 portion is stronger than a negative pressure generated by an attitude difference such as a positional difference between the print head 4 and the main ink tank 2, the meniscus force of the filter 16 holds the ink. Hence, the ink is held by the filter 16 and therefore remains in the ink supply tube 7.

Figure 5:
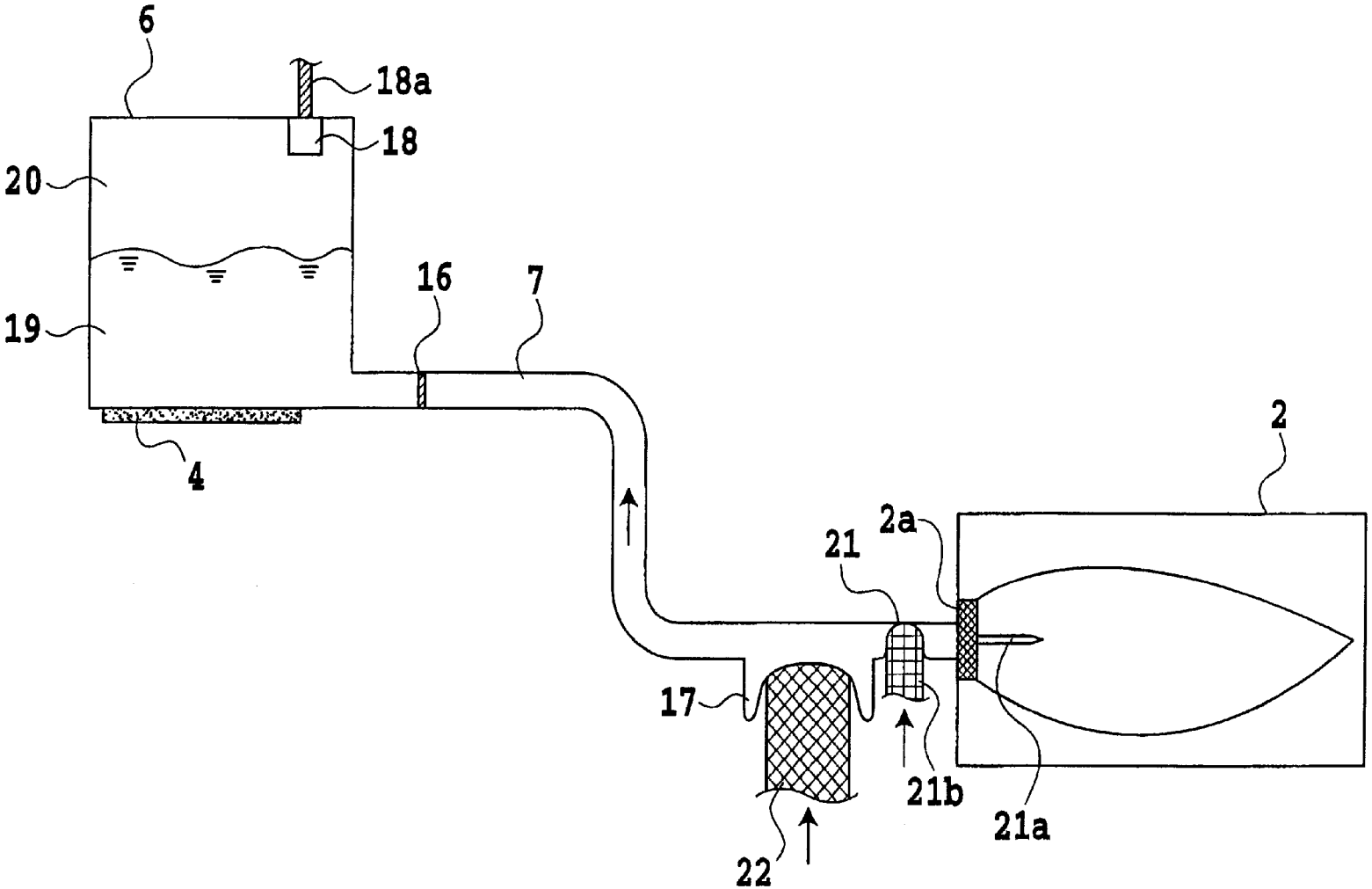
FIG. 5 is a schematic diagram showing the print head performance recovery procedure of FIG. 4 while in operation.

Next, with the valve 18 left open as shown in FIG. 5, the ink supply tube 21 between the ink chamber 17 provided in the ink supply tube 7 and the main ink tank 2 is pressed or clamped by a pressing member 21*b* or any other appropriate means to close the ink supply tube 7. Then, by pressing the ink chamber 17 with a pressing member 22 provided in the ink jet printing apparatus, it is possible to supply to the sub ink tank 6 a predetermined amount of ink equal to the volume of the ink chamber 17 without sending the ink to the main ink tank 2.

As a final step, the valve 18 in the sub ink tank 6 is closed and the ink supply tube 21 and the ink chamber 17 are opened or released. This allows a desired negative pressure generated by the attitude difference between the sub ink tank 6 and the main ink tank 2 to be applied to the sub ink tank 6, with the result that the printing can be performed again. Further, when the valve 18 in the sub ink tank 6 is closed while the ink is being supplied from the ink chamber 17 to the sub ink tank 6, the internal pressure of the sub ink tank 6 rises, forcing the ink out of the nozzles of the print head 4. The valve 18 is closed at a timing when the amount of ink forced out is minimum. This method can restore the original ink ejection performance of the print head from the nozzle-clogged state with a very small amount of discarded ink.

Since, with this method of recovery, the amount of ink to be injected into the sub ink tank 6 is always constant, it is possible to inject a constant amount of ink into the sub ink tank 6 at desired intervals according to the volume of the sub ink tank 6 without having to use any ink level sensor in the sub ink tank 6 or without causing any ink leakage. The recovery of the ejection of the print head 4 can also be achieved without discarding ink at all or with a very small amount of discarded ink.

While the method of supplying a predetermined amount of pressurized ink from the main ink tank 2 to the sub ink tank 6 involves pressing the ink chamber 17 with the pressing member 22 to pressurize the ink, the present invention is not limited to this method and various other methods may be used. Among other methods are the one that directly presses the main ink tank 2 and the one that injects ink from the ink chamber 17 such as a syringe.

Thus, with the method of supplying ink in the ink jet print apparatus and the method of recovering the print head in the ink jet printing apparatus of the present invention, because the amount of ink to be supplied is known, the ink can be prevented from overflowing from the sub ink tank when it is supplied from the main ink tank to the sub ink tank and a constant amount of ink can be injected.

Embodiment 2

Figure 6:
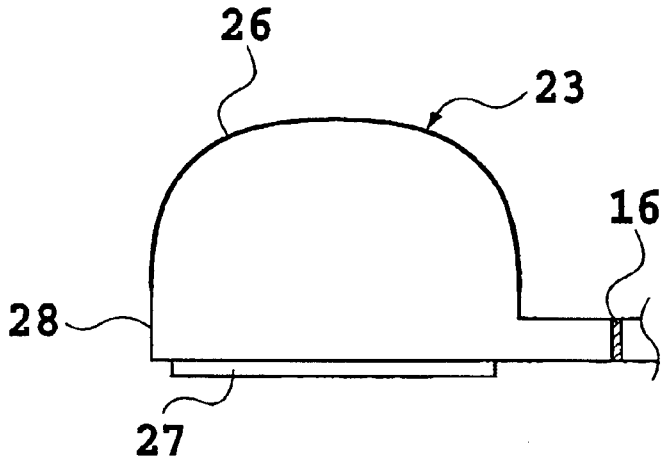
FIG. 6 is a schematic diagram showing a sub ink tank of an ink jet print head in a second embodiment of the present invention.

FIG. 6 schematically shows a sub ink tank of the print head according to a second embodiment of the present invention.

As shown in the figure, the sub ink tank 23 has a wall 26 made from a flexible rubber member; an ink jet print head 27 having energy generating elements and nozzles to eject ink such as same members used in the above embodiment 1; and a support member 28 made from resin to support a chip of the print head 27. The support member 28 forms a part of a liquid chamber. While in this embodiment, the sub ink tank 23 uses the wall 26 made from a resilient rubber member or the like, the present invention is not limited to this construction. For example, the wall 26 may use a resin film urged by a spring as long as it permits the sub ink tank 23 to change its volume and does not adversely affect the ink ejection during printing. Although not shown in FIG. 6 of this embodiment, the construction ranging from the filter 16 to the main ink tank 2 is similar to that of the embodiment 1.

The method of restoring the sub ink tank 23 of the embodiment 2 to the original performing state will be described by referring to FIG. 7.

Figure 7A:
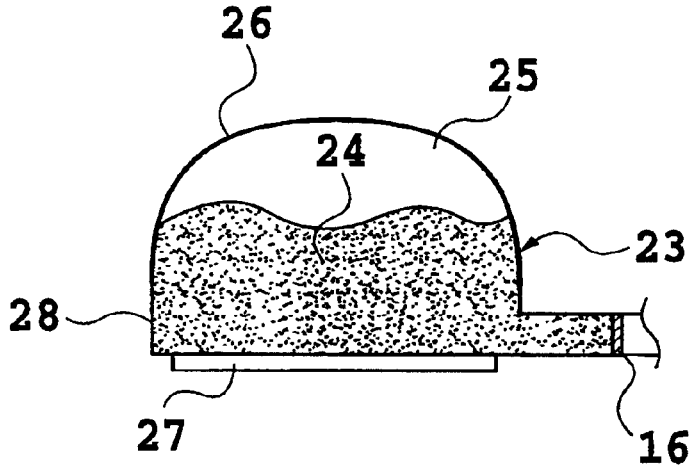
FIG. 7A and FIG. 7B are schematic diagrams showing a print head performance recovery procedure in the second embodiment of the present invention, with FIG. 7A representing a state before the start of the recovery procedure and FIG. 7B representing a state while the recovery procedure is in operation.
Figure 7B:
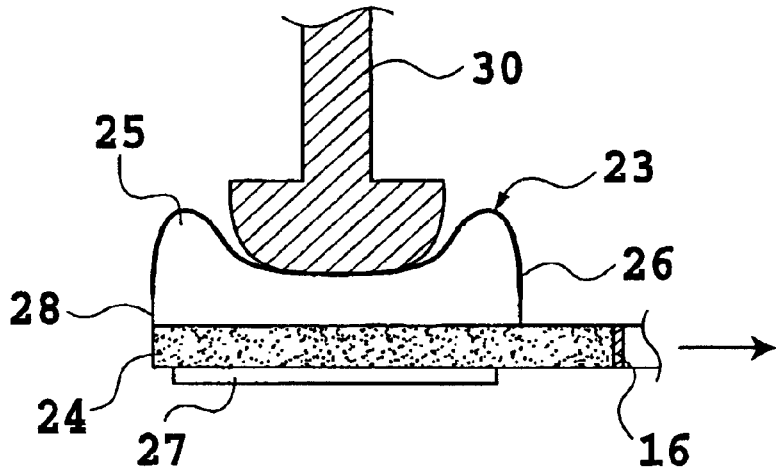

Initially, there is ink 24 and air 25 in the sub ink tank 23, as shown in FIG. 7A. For a recovery operation, the wall 26 made from a resilient member which is provided to the sub ink tank 23 is slowly pressed by a pressing member 30 provided in the ink jet printing apparatus, as shown in FIG. 7B. This forces the ink 24 present in the sub ink tank 23 to be pushed out through the filter 16 toward the main ink tank 2. When the sub ink tank 23 is emptied of ink, the meniscus force of the filter 16 holds the ink in the ink supply tube 7. In this state, as the pressing member 30 is further pushed against the resilient wall 26 of the sub ink tank 23, if the meniscus force at the nozzle portion of the print head 27 is set smaller than the meniscus force at the filter 16, the meniscus of the nozzle portion is broken allowing the air 25 in the sub ink tank 23 to be discharged through the nozzle portion of the print head 27.

As the pressing member 30 continues to be pushed from the state shown in FIG. 7B until the resilient wall 26 fully collapses, the air in the sub ink tank 23 is discharged almost completely from the sub ink tank 23, with only a small amount of air left in it. Then, the ink chamber (not shown) is pressurized, as described in the embodiment 1, to supply ink toward the sub ink tank 23. At the same time, reducing or releasing the pressing force of the pressing member 30 acting on the resilient wall 26 permits a predetermined amount of ink to be injected into the sub ink tank 23.

As can be seen from the foregoing explanation, the present invention eliminates bubbles remaining in the sub ink tank 6, 23 attached to the print head 4, 27 either by the method which first returns the ink present in the sub ink tank 6, 23 to the main ink tank 2 and then injects the ink into the sub ink tank 6, 23 while at the same time drawing air from the sub ink tank 6, 23 or by the method which first returns the ink in the sub ink tank 6, 23 to the main ink tank 2, expels the air from the sub ink tank 6, 23 and then injects ink from the main ink tank 2 into the sub ink tank 6, 23. With these methods, since the amount of ink or the amount of air present in the sub ink tank 6, 23 can be set to an almost constant level each time the recovery operation is performed, there is no need to provide an ink level (amount of remaining ink) detection mechanism in the sub ink tank 6, 23, the ink can be prevented from overflowing, and a predetermined amount of ink can be injected. It is therefore possible to provide an ink jet printing apparatus with an ink supply and ejection performance recovery capability which has high reliability and high ink injection precision and produces only a very small amount of discarded ink.

Others

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out a preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus comprising:

an ink jet print head for ejecting ink;

a sub ink tank for temporarily holding the ink to be ejected from the print head;

a main ink tank for holding the ink to be supplied to the sub ink tank, arranged at a height lower than the ink jet print head;

a tube for establishing a communication between the sub ink tank and the main ink tank, provided with a flexible ink chamber for supplying ink to the sub ink tank and a valve to be arranged between the ink chamber and the main ink tank; and a pressing member for pressurizing the ink chamber.

2. The ink jet printing apparatus according to claim 1, wherein the ink jet print head has an ink jet print chip that has energy generating elements for ejecting ink and a nozzle portion for ejecting ink, and the chip is arranged on one of surfaces of the sub ink tank.

3. The ink jet printing apparatus according to claim 1, wherein the sub ink tank has a valve for communicating the sub ink tank to external air.

4. The ink jet printing apparatus according to claim 1, further comprising a pressing member for pressurizing the sub ink tank made from a flexible member.

5. The ink jet printing apparatus according to claim 1, wherein an ink supply to the sub ink tank is accomplished by a pit-in system in which the sub ink tank is connected to the main ink tank when necessary.

6. The ink jet printing apparatus according to claim 1, wherein the sub ink tank is provided with a filter on the main ink tank side.

7. The ink jet printing apparatus according to claim 1, wherein the ink jet print head is removably mounted on the ink jet printing apparatus along with the sub ink tank.

8. The ink jet printing apparatus according to claim 1, wherein the ink jet print head has, as elements for generating energy to eject the ink, electrothermal transducers that generate thermal energy and thereby cause film boiling in the ink.

9. A method of supplying ink used in an ink jet printing apparatus, wherein the ink jet printing apparatus comprises an ink jet print head for ejecting ink, a sub ink tank for temporarily holding the ink to be ejected from the print head, a main ink tank for holding the ink to be supplied to the sub ink tank, arranged at a height lower than the ink jet print head, a tube for establishing a communication between the sub ink tank and the main ink tank, the tube being provided with a flexible ink chamber for supplying ink to the sub ink tank and a valve arranged between the ink chamber and the main ink tank, and a pressing member for pressurizing the ink chamber, the method of supplying ink comprising:

a first step of returning the ink in the sub ink tank to the main ink tank;

a second step of discharging bubbles in the sub ink tank out of the sub ink tank; and a third step of, after the first step, supplying a predetermined amount of ink from the ink chamber to the sub ink tank by pressurizing the ink chamber with the pressing member under the condition where the valve between the ink chamber and the main ink tank is closed.

10. A method for recovering an ink jet print head used in an ink jet printing apparatus with an ink supply path, wherein the ink jet printing apparatus comprises an ink jet print head for ejecting ink, a sub ink tank for temporarily holding the ink to be ejected from the print head, the sub ink tank having a valve for establishing a communication with external air, a main ink tank for holding the ink to be supplied to the sub ink tank, arranged at a height lower than the ink jet print head, and a tube for establishing a communication between the sub ink tank and the main ink tank, the tube being provided with an ink chamber made from a flexible member for supplying ink to the sub ink tank and a valve arranged between the ink chamber and the main ink tank and further provided with a pressing member for pressurizing the ink chamber, the method of recovering the ink jet print head comprising:

a first step of returning the ink in the sub ink tank to the ink chamber by opening the valve of the sub ink tank;

a second step of supplying the ink from the ink chamber to the sub ink tank by, after the first step, pressurizing the ink chamber with closing the valve arranged between the main ink tank and the ink chamber; and a third step of ejecting the ink from the print head by, after the second step, closing the valve of the sub ink tank in the condition where the valve between the main ink tank and the ink chamber is closed to pressurize the ink chamber.

11. A method for recovering an ink jet print head used in an ink jet printing apparatus with an ink supply path, wherein the ink jet printing apparatus comprises an ink jet print head for ejecting ink, a sub ink tank for temporarily holding the ink to be ejected from the print head, made from a flexible member, a main ink tank for holding the ink to be supplied to the sub ink tank, arranged at a height lower than the ink jet print head, a tube for establishing a communication between the sub ink tank and the main ink tank, the tube being provided with a flexible ink chamber for supplying the ink to the sub ink tank and a valve arranged between the ink chamber and the main ink tank, and pressing members for pressurizing the ink chamber and the sub ink tank respectively, the method of recovering the ink jet print head comprising:

a first step of returning the ink in the sub ink tank to the ink chamber by pressurizing the sub ink tank; and a second step of ejecting the ink from the ink jet print head by further pressurizing the sub ink tank subsequent to the first step.

12. The method according to claim 11, wherein a meniscus force generated at a filter installed in the sub ink tank on the main ink tank side is stronger than a meniscus force generated at a nozzle portion of the ink jet print head.

* * * * *